US005573202A

United States Patent [19]

Morgavi

[11] Patent Number: 5,573,202

[45] Date of Patent: Nov. 12, 1996

[54] SYSTEM AND METHOD FOR CONTROLLING THE WINDING OF A RIBBON ON A RECEIVER REEL

[75] Inventor: Paul Morgavi, La Ciotat, France

[73] Assignee: Gemplus Card International, Gemenos, France

[21] Appl. No.: 394,015

[22] Filed: Feb. 23, 1995

[30] Foreign Application Priority Data

Feb. 24, 1994 [FR] France ..... 94 02118

[51] Int. Cl.[6] ..... B65H 18/08; B65H 26/06

[52] U.S. Cl. ..... 242/534.2; 242/543

[58] Field of Search ..... 242/534.2, 543, 242/563.2

[56] References Cited

FOREIGN PATENT DOCUMENTS 60-038191 2/1985 Japan .

61-024491 2/1986 Japan .

1-275361 11/1989 Japan ..... 242/534.2

21-85474 7/1990 Japan .

30-043274 2/1991 Japan .

*Primary Examiner*—John Q. Nguyen

*Attorney, Agent, or Firm*—Pollock, Vande Sande & Priddy

[57] ABSTRACT

A system controls the winding of a ribbon on a receiver reel rotationally driven by a stepping motor. The ribbon has successive indicators at regularly spaced intervals on the ribbon. A detection device, having two spaced optical cells at a predetermined distance between them, detects the passage of an indicator between the cells. A microprocessor counts the number of steps of the stepping motor that have been necessary to achieve movement of an indicator between the optical cells. The microprocessor also computes the number of pulses to be applied to the stepping motor per unit time to achieve a constant speed of the ribbon as it passes between cells.

5 Claims, 1 Drawing Sheet

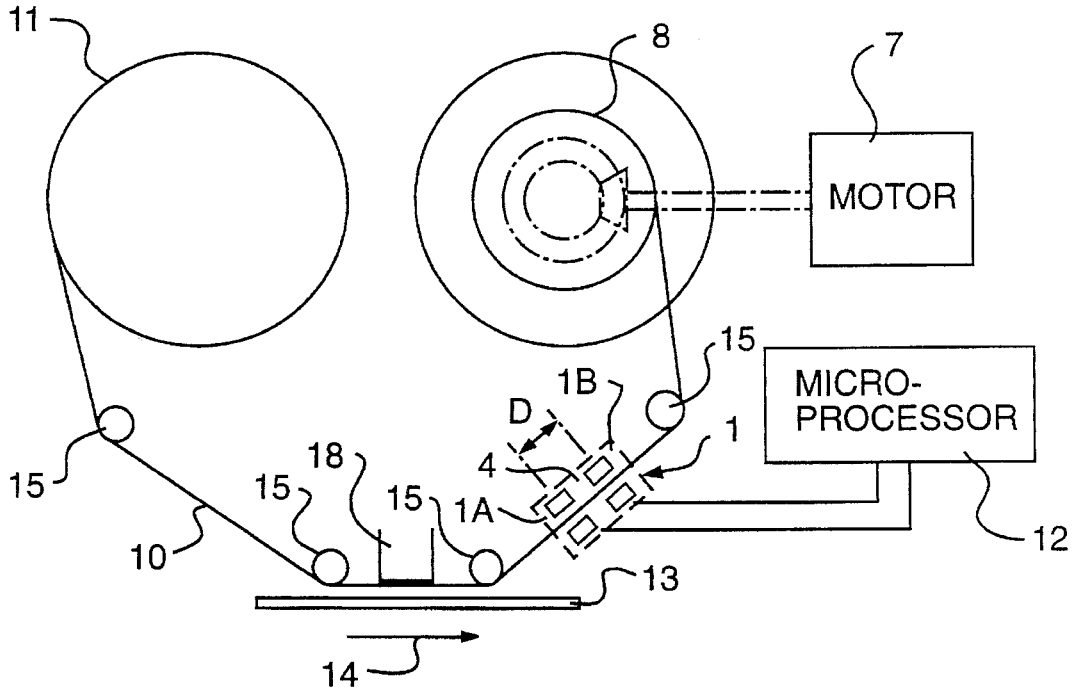
FIG. 1
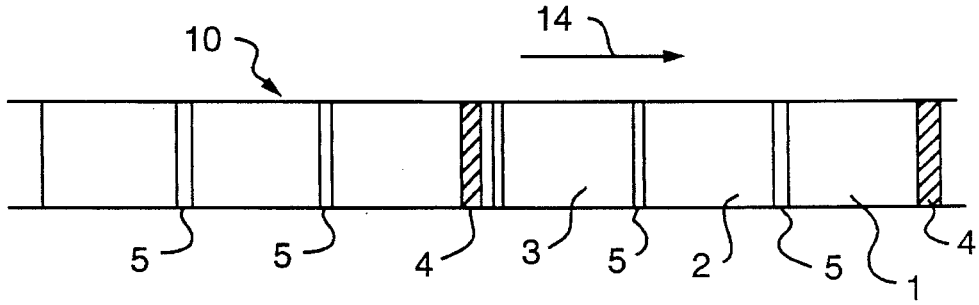
FIG. 2
FIG. 3
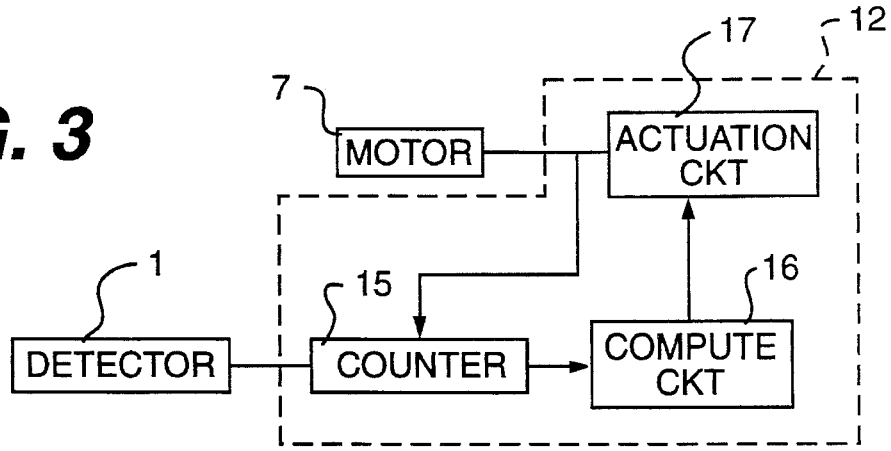

SYSTEM AND METHOD FOR CONTROLLING THE WINDING OF A RIBBON ON A RECEIVER REEL

BACKGROUND OF THE INVENTION

1. Field of the Invention

The present invention relates to a system for controlling the winding of a ribbon on a receiver reel, the ribbon being designed for the thermal transfer of coloring agents that are arranged sequentially on the ribbon.

2. Description of the Prior Art

There is the known technology of thermal transfer in which the coloring agent is deposited and fixed to the surface to be printed by means of the resistors that form a thermal printer head heating a ribbon, coated with coloring agents, by means of a modulated electrical current.

There is also the known technology of thermal transfer whereby there are sequentially deposited primary coloring agents, namely yellow, magenta, cyan that can be used for the obtaining, by the combination of different wavelengths called subtractive wavelengths, of a range of several millions of colors and shades.

To obtain high-definition printing quality, especially in work for the graphic customizing of memory cards, it is imperative to achieve perfect synchronization of the speed at which the ribbon runs under the printing head with the speed of horizontal translation of the card to be printed under said head.

The ribbon is presented wound on a storage reel the shaft of which rotates freely. Another reel, called a receiver reel, is used to wind the ribbon after use and is provided with a driving motor means. For a constant speed of linear shift beneath the thermal printing head, the winding speed, expressed in turns of the receiver reel, varies at each turn since the diameter of the circumference of the winding drum increases by the thickness of a new wound layer.

SUMMARY OF THE INVENTION

The object of the invention is to implement a system in order to control a driving motor of a receiver reel of a ribbon that makes it possible to obtain a constant linear speed of the ribbon irrespective of the diameter of winding of the ribbon on the receiver reel.

The invention relates to a system for controlling the winding of a ribbon on a receiver reel rotationally driven by a driving means, wherein:

the driving means is a stepping motor;

the ribbon has successive indicators;

a detection device, during the passage of an indicator, detects the running of a determined length of the ribbon, and a microprocessor type electronic device counts the number of steps of the stepping motor that have been necessary to bring about the running of the ribbon by a determined length, and that computes the number of pulses to be applied to the stepping motor per time unit to make the ribbon run at constant linear speed for the distance between two successive indicators.

The electronic device comprises:

an electronic counting circuit that counts the number of steps performed by the stepping motor for this determined length, a computation step which, on the basis of said number of steps corresponding to this determined length and to the number of steps per turn of the receiver reel, determines the circumference of the receiver reel, thus enabling the computation of a number of steps to be performed per time unit so that the linear speed of the ribbon remains constant, and an electronic actuating circuit that gives said driving means a number of pulses per time unit that is equal to the number of steps per time unit computed by said computation circuit.

According to one feature of the invention, the detection device comprises two elementary detection cells that are separated, in the direction of the running of the ribbon, by a distance equal to the determined length.

According to another feature of the invention, this determined length is measured by the number of steps between the instants of passage of an indicator before the two elementary detection cells.

The invention also relates to a method for controlling the winding of a ribbon on a receiver reel driven by stepping-motor type driving means, said method comprising the following steps:

positioning successive indicators on said ribbon, making the ribbon run before a detection device, detecting the running of a determined length of the ribbon during the passage of an indicator, determining the number of steps performed by the stepping motor for this determined length;

computing the number of steps to be performed per time unit so that the linear speed of the ribbon remains constant between two successive indicators, and applying a number of pulses per time unit to said driving means that is equal to the number of steps computed during the previous step.

BRIEF DESCRIPTION OF THE DRAWING

Other features and advantages of the present invention shall appear from the following description of a particular exemplary embodiment, said description being made with reference to the appending drawing, wherein:

FIG. 1 is a schematic view of a system for controlling the winding of a ribbon on a receiver reel according to the invention;

FIG. 2 shows a view of a ribbon for a thermal transfer of coloring agents, said ribbon having features of the invention, and FIG. 3 is a block diagram of the control system according to the invention.

DETAILED DESCRIPTION OF THE INVENTION

The system for controlling the winding of a ribbon on a receiver reel according to the invention shall be described in its application to a color printer of the type in which the coloring agents corresponding to the primary colors are arranged sequentially on the ribbon and are transferred successively to a medium to be printed on by thermal effect.

In such a color printer, a ribbon 10 is used as a supporting structure for coloring agents arranged sequentially in the following order: yellow 1, magenta 2, cyan 3. Each three-color segment is separated from the next one by a strip 4, which is black for example, having a length of 15 millimeters for example. Each color is separated from the next one by a strip 5, black for example, that has a length of 5 millimeters for example.

Hereinafter in the description, the strips 4 shall be designated as sequence indicators called indicators, and the strips 5 shall be designated as color indicators, also called separators.

The lengths of the colors on a ribbon are generally equal but may vary from one ribbon to another as a function of the length of the card to be printed on and of the regions on this card that are to be printed on.

Before use, the ribbon 10 is wound on a storage reel 11. During the printing, the ribbon 10 gets wound on a receiver reel 8 that is rotationally driven by a driving motor 7. Between the storage reel and the receiver reel, the ribbon 10 passes in front of a thermal printer head 18 beneath which there passes a medium 13 to be printed on. The means for driving the medium 13 have not been shown in FIG. 1. Rollers 15 are designed to deflect the ribbon 10 so as to present it beneath the thermal printer head 18. The arrow 14 indicates the running direction of the ribbon 10.

The system for controlling the winding of the ribbon 10 comprises the following elements:

a stepping type motor 7, a detection device 1 which, during the passage of an indicator 4, detects the running of a determined length D of the ribbon, a microprocessor type electronic device 12 that counts the number of steps of the stepping motor 7 that have been necessary to cause the running of the ribbon of determined length, and that computes the number of pulses to be applied to the stepping motor 7 per time unit to make the ribbon 10 run at a constant linear speed for the distance between two successive indicators 4.

More specifically, the electronic device 12 comprises (FIG. 3) an electronic counting circuit 15 that counts the number of steps of the motor to travel the determined distance. This number is used, in a computation circuit 16 and in combination with the number of steps per turn of the receiver reel, to compute the circumference of the receiver reel as well as the number of steps to be performed per time unit so that the speed of the ribbon remains constant and equal to that of the medium 13 to be printed on. This number of steps per time unit is used in an electronic actuation circuit 17 for the preparation, per time unit, of a number of actuation pulses for the stepping motor 7 that is equal to the number of steps computed by the electronic computation circuit 16.

The detection device 1 preferably has two optical cells 1A and 1B that are separated, in the running direction 14, by a distance that is precisely equal to a determined length D to be detected, for example 7½ millimeters. To detect the running of this determined length D of 7½ millimeters, the indicator 4 and, more specifically, the rear side (trailing edge) is used in the running direction by detecting the instants of the demasking of, first of all, the cell 1A and then the cell 1B.

Between these two demasking instants, the ribbon has run the intercell distance D of 7½ millimeters, which corresponds to a determined number n of steps of the motor 7 which are counted by the counting circuit 15 on the basis of the control pulses of the circuit 17.

From the value of D, the number n of steps, the number N of steps per turn of the receiver reel and the linear speed V to be obtained for the ribbon, the circuit 17 computes the number of pulses P per time unit, for example per second, to be applied to the motor 7 to obtain this speed V during the running of the ribbon up to the next indicator 4.

By way of an indication, the stepping motor 7 is designed to carry out 3200 steps or microsteps to make the receiver reel rotate by a complete turn, thus enabling high precision to be obtained.

What is claimed is:

1. An apparatus for regulating the speed of a ribbon linearly passing between supply and receiver spools and comprising:

a stepping motor for driving the receiver spool;

a plurality of indicators formed on the ribbon at regularly spaced intervals;

a first detection device mounted in registry with the ribbon for sensing passage of an indicator thereacross;

a second detection device mounted in registry with the ribbon and displaced from the first detection device by a predetermined distance for sensing passage of the indicator on the ribbon across the predetermined distance;

microprocessing means for counting the steps of the stepping motor that have occurred to cause the ribbon to traverse the predetermined distance, and for computing the number of pulses to be applied to the stepping motor per unit time that regulates the ribbon speed to a constant value.

2. The apparatus set forth in claim 1 wherein the microprocessing means further comprises:

a counter that counts the number of stepping motor steps;

a computing circuit for determining the instantaneous circumference of the receiver spool from the number of steps counted by the counter as the indicator passes between the detection devices, and the number of steps per turn of the receiver spool, thus enabling the computation of a number of steps per unit time that the motor must perform to maintain a constant ribbon speed; and an actuating circuit for supplying the stepping motor with the number of pulses per unit time that equals the number of steps per unit time as computed by the computing circuit.

3. The apparatus set forth in claim 2 wherein the detection devices further comprise two optical cells.

4. The apparatus set forth in claim 3 wherein the optical cells detect the trailing edge of each indicator for determining a time interval during which there occurs a count of the number of steps of the stepping motor.

5. A method for regulating the speed of a ribbon linearly passing between supply and receiver spools and comprising the steps:

locating successive indicators positioned at regularly spaced intervals on the ribbon, passing the ribbon between supply and receiver spools;

driving the receiver spool in steps by a stepping motor;

locating the ribbon in registry with two detection devices that are displaced from each other by a predetermined distance;

detecting passage of the ribbon bearing an indicator across the predetermined distance bounded by the detection devices;

determining the number of steps of the stepping motor per unit time during movement of the ribbon along the predetermined distance;

computing the number of steps of the stepping motor necessary per unit time to maintain a constant ribbon speed; and applying a number of pulses per unit time to the stepping motor that is equal to the computed number of steps.

* * * * *